US007717736B2

(12) United States Patent
Chua et al.

(10) Patent No.: US 7,717,736 B2
(45) Date of Patent: May 18, 2010

(54) SHEATH FOR A FLEXIBLE ELECTRICAL CONTACT

(75) Inventors: Keng Hwa Chua, Singapore (SG); Kin Wah Chan, Singapore (SG); Eng Kan Melvin Soh, Singapore (SG)

(73) Assignee: Creative Technology Ltd, Singapore (SG)

( * ) Notice: Subject to any disclaimer, the term of this patent is extended or adjusted under 35 U.S.C. 154(b) by 503 days.

(21) Appl. No.: 11/757,279

(22) Filed: Jun. 1, 2007

(65) Prior Publication Data

US 2008/0299839 A1 Dec. 4, 2008

(51) Int. Cl.
*H01R 3/00* (2006.01)

(52) U.S. Cl. ..... 439/500; 439/934; 439/700

(58) Field of Classification Search ..... 439/500, 439/700, 824, 840, 934, 382; 429/121, 96, 429/100

See application file for complete search history.

(56) References Cited

U.S. PATENT DOCUMENTS

| | | | | |
|---|---|---|---|---|
| 965,103 | A * | 7/1910 | Goodridge | 439/734 |
| 6,783,390 | B2 * | 8/2004 | Berg et al. | 439/500 |
| 6,942,359 | B2 * | 9/2005 | Furth et al. | 362/205 |
| 7,152,854 | B2 * | 12/2006 | Uchida | 267/178 |
| 7,247,048 | B2 * | 7/2007 | Yokoyama | 439/500 |
| 2003/0077937 | A1 * | 4/2003 | Berg et al. | 439/500 |

* cited by examiner

*Primary Examiner*—Neil Abrams
*Assistant Examiner*—Phuong Nguyen

(57) ABSTRACT

There is provided a sheath for a flexible electrical contact that is incorporated within a sound reproduction device. The sheath preferably includes at least one opening at each end of the sheath to enable the sheath to be worn over the electrical contact with each opening having a thickened periphery ring. The main body of the sheath may be either a cylindrical shape or a conical shape. It is advantageous that the sheath damps a resonance vibration of the flexible electrical contact during operation of the sound reproduction device when the sheath is worn over the flexible electrical contact. The flexible electrical contact may be incorporated within a battery compartment of the sound reproduction device. A corresponding method of using the sheath is also disclosed.

12 Claims, 4 Drawing Sheets

SHEATH FOR A FLEXIBLE ELECTRICAL CONTACT

FIELD OF INVENTION

The present invention relates to a sheath for use with a flexible electrical contact incorporated in a sound reproduction device to minimize resonance vibration of the flexible electrical contact during operation of the sound reproduction device.

BACKGROUND

The explosive growth in demand for portable digital entertainment devices has correspondingly led to an increase in demand for accessories for use with such portable digital entertainment devices. It is likely that such accessories will include, for example, earphones, headphones, speakers and other sound reproduction devices. It is likely that these sound reproduction devices are also portable and either draw power from the portable digital entertainment devices or are independently powered.

Portable power sources used by the independently powered sound reproduction devices like speakers include dry cell batteries. These speakers usually have at least one compartment/receptacle for placement of the dry cell batteries to enable the operability of the speakers. It is common practice that conductive electrical contacts are used in the at least one compartment/receptacle to enable electrical connectivity between the dry cell batteries and the speakers. It is also common for such sound reproduction devices to be able to operate using an alternative power source like an AC power source such as an electrical mains supply. In this regard, when the sound reproduction device is operating while using an AC power source, the compartment/receptacle for the dry cell batteries is usually left empty unless the dry cell batteries are able to be recharged by the AC power source when placed in the at least one compartment/receptacle.

As such, when the compartment/receptacle for the dry cell batteries is empty when the sound reproduction device is in operation, the conductive electrical contacts would generally tend to resonate and correspondingly create undesirable resonance noise. These resonance noises (vibrations) directly affect the quality of sound reproduction in a detrimental manner.

While the resonance vibrations of the conductive electrical contact may be minimized by increasing the stiffness of the material used, this may affect the ease of dry cell battery placement in the compartment/receptacle. This would be detrimental to the usability of the sound reproduction device.

SUMMARY

In a first aspect of the present invention, there is provided a sheath for a flexible electrical contact that is incorporated within a sound reproduction device. The sheath preferably includes at least one opening at each end of the sheath to enable the sheath to be worn over the electrical contact with each opening having a thickened periphery ring. The main body of the sheath may be either a cylindrical shape or a conical shape. It is advantageous that the sheath damps a resonance vibration of the flexible electrical contact during operation of the sound reproduction device when the sheath is worn over the flexible electrical contact. The flexible electrical contact may be incorporated within a battery compartment of the sound reproduction device.

It is preferable that the sheath may be made of a material of a type selected from for example, heat-resistant, chemical-resistant, elastic, flexible, compressible or any combination of the aforementioned. The material may be either rubber or a polymer.

Removal of the sheath from the flexible electrical contact may be hampered due to measures such as, for example, constriction of the main body of the sheath around the flexible electrical contact, constriction of the thickened periphery rings on the flexible electrical contact, having a high coefficient of friction in an inner surface of the sheath contacting the flexible electrical contact or any combination of the aforementioned. Advantageously, the thickened periphery rings may aid in securing the sheath to the flexible electrical contact during compression and subsequent rebound of the flexible electrical contact.

In a secondary aspect of the present invention, there is provided a method to minimize resonance vibration from a flexible electrical contact incorporated within an operational sound reproduction device by using a sheath worn over the flexible electrical contact. Such a sheath may preferably be made of a material of a type that is heat-resistant, chemical-resistant, elastic, flexible, compressible or any combination of the aforementioned. The material may be either rubber or a polymer. Removal of the sheath from the flexible electrical contact may be hampered due to measures such as, for example, constriction of the main body of the sheath around the flexible electrical contact, constriction of the thickened periphery rings on the flexible electrical contact, having a high coefficient of friction in an inner surface of the sheath contacting the flexible electrical contact or any combination of the aforementioned. Advantageously, the thickened periphery rings may aid in securing the sheath to the flexible electrical contact during compression and subsequent rebound of the flexible electrical contact.

DESCRIPTION OF DRAWINGS

In order that the present invention may be fully understood and readily put into practical effect, there shall now be described by way of non-limitative example only preferred embodiments of the present invention, the description being with reference to the accompanying illustrative drawings.

DESCRIPTION OF PREFERRED EMBODIMENTS

Figure 1:
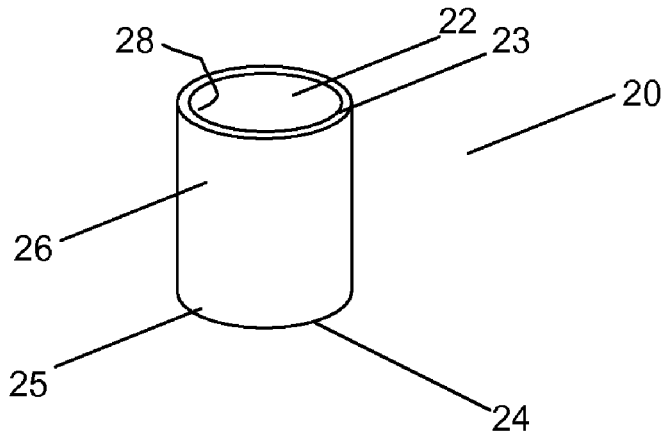
FIG. 1 shows a perspective view of a first embodiment of the present invention.
Figure 2:
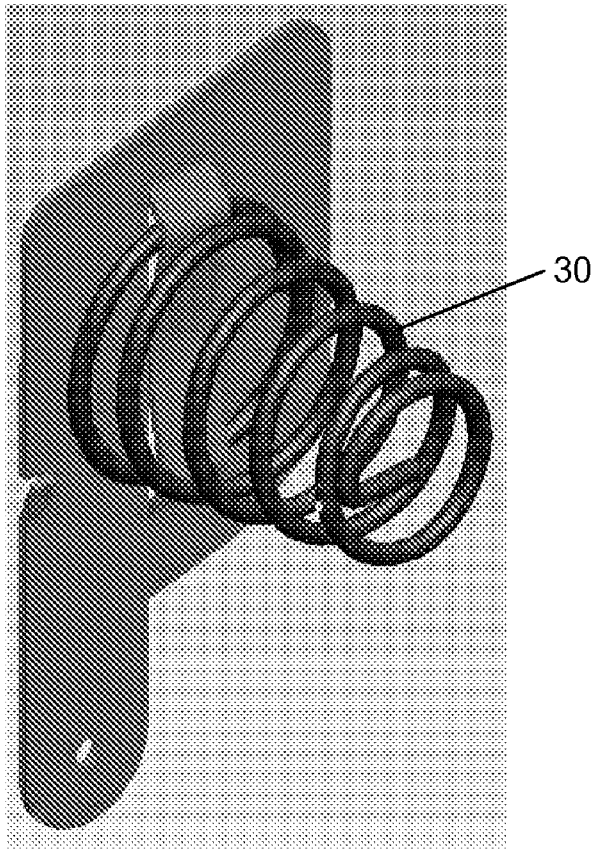
FIG. 2 shows a perspective view of a flexible electrical contact.
Figure 3:
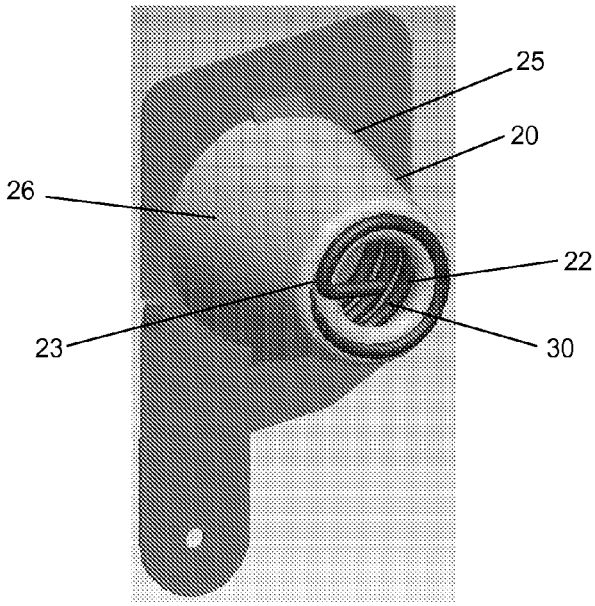
FIG. 3 shows a perspective view of the flexible electrical contact of FIG. 2 wearing a second embodiment of the present invention.
Figure 4:
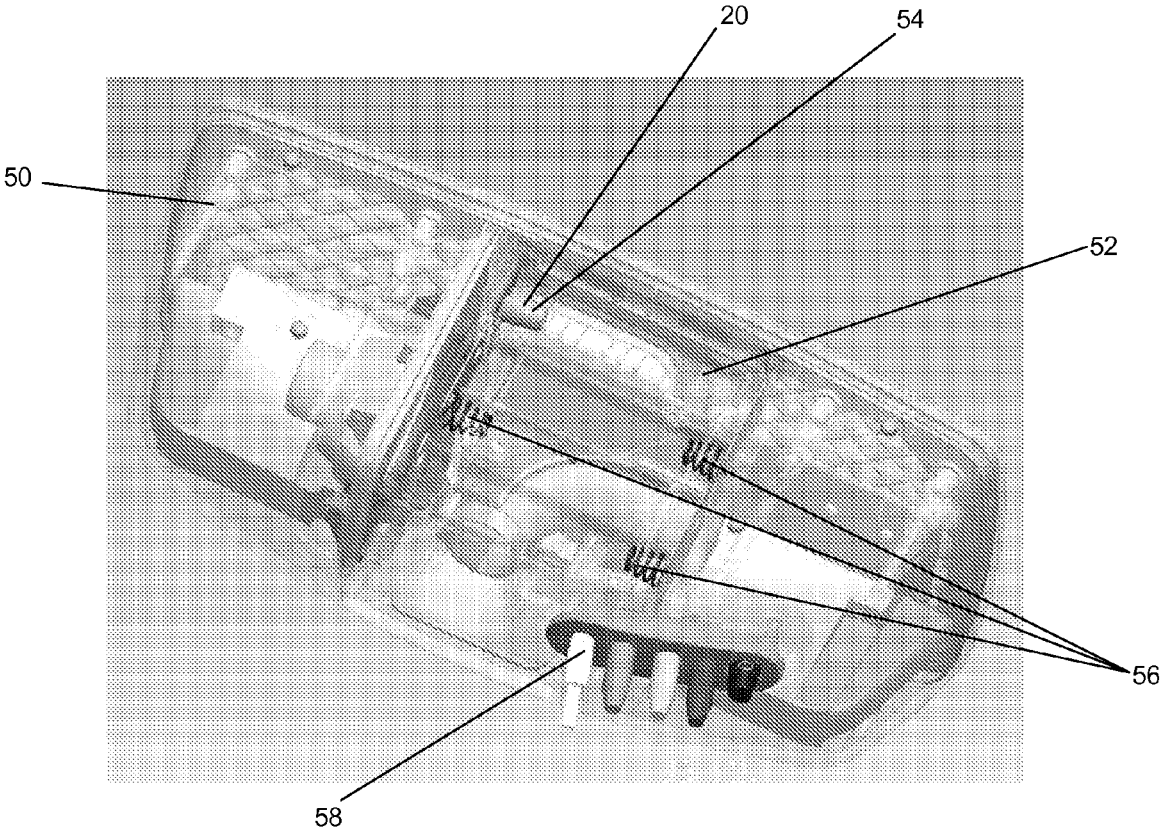
FIG. 4 shows a perspective view of an empty dry cell battery compartment of a sound reproduction device employing the second embodiment of the present invention.
Figure 5:
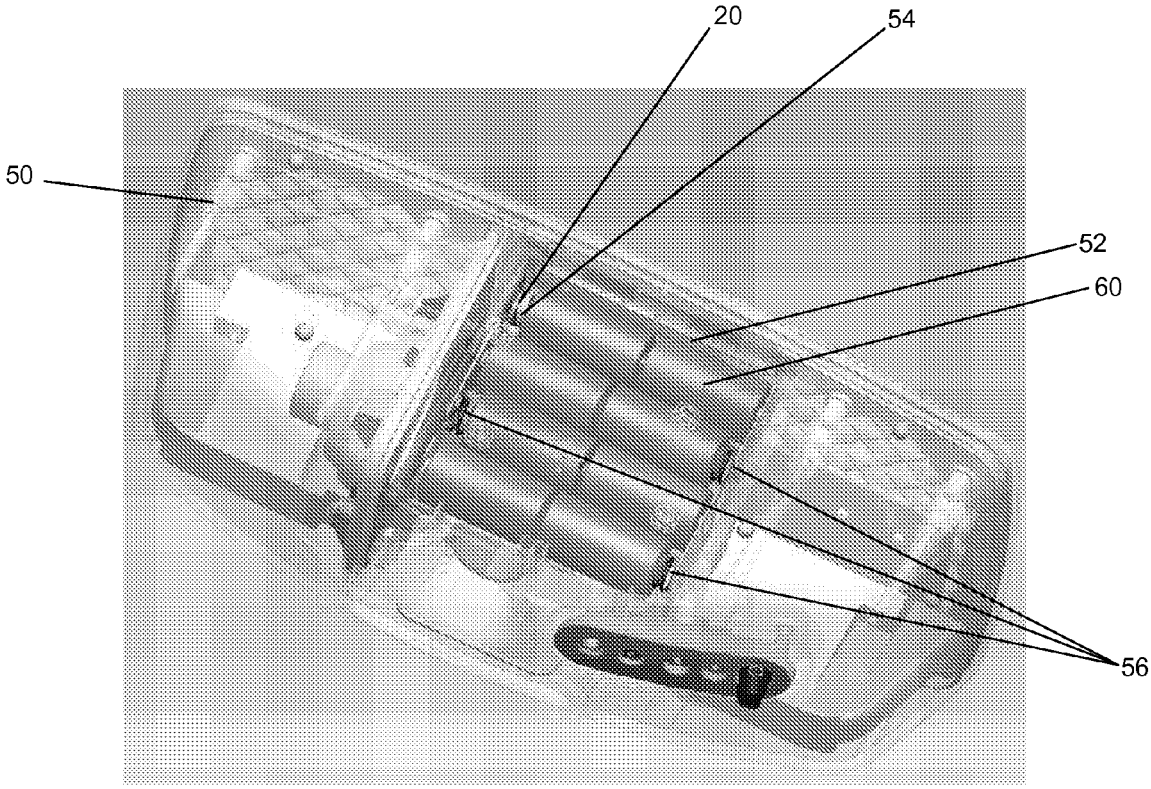
FIG. 5 shows a perspective view of a fully loaded dry cell battery compartment of the sound reproduction device employing the second embodiment of the present invention.

Referring to FIGS. 1-5, there is provided preferred embodiments of the present invention in the form of a sheath 20 for a flexible electrical contact (30 in FIGS. 2-3) that is incorporated within a sound reproduction device (50 in FIGS. 4-5). The sheath 20 may include at least one opening at each end 22, 24 of the sheath 20 to enable the sheath 20 to be worn over the electrical contact 30. Each end 22, 24 of the sheath 20 may have a thickened periphery ring 23, 25 respectively to aid in securing the sheath 20 to the electrical contact 30 when the sheath 20 is worn over the electrical contact 30. The thickened periphery rings 23, 25 may aid in securing the sheath 20 to the electrical contact 30 during compression and subsequent rebound of the electrical contact 30 (by constricting around the respective ends 22, 24 of the sheath 20). The sheath 20 may include a main body 26 which may be of either a cylindrical shape (as shown in FIG. 1) or a conical shape (as shown in FIGS. 3-5). The shape of the main body 26 need not be restricted to the aforementioned shapes.

The sheath 20 may be made from a material that may be heat-resistant, chemical-resistant, elastic, flexible, compressible or any combination of the aforementioned. Heat resistance of the material may be essential as it would be detrimental to the performance of the electrical contact 30 if the sheath 20 melts or undergoes heat induced deformation. Chemical resistance of the material may be essential as it would be detrimental to the performance of the electrical contact 30 if the sheath 20 chemically reacts when coming into contact with chemicals like alkalis that leak from dry cell batteries. The material used for the sheath 20 may be either rubber or a polymer. The material used may enable the main body 26 of the sheath 20 to constrict around the electrical contact 30 when the sheath 20 is worn on the electrical contact 30 as shown in FIG. 3. The constriction of the main body 26 of the sheath 20 around the electrical contact 30 may hamper removal of the sheath 20 when the sheath 20 is worn on the flexible electrical contact 30. Constriction of the thickened periphery rings 23, 25 may also aid in securing the sheath 20 to the electrical contact 30. Alternatively, an inner surface 28 of the sheath 20 in contact with the flexible electrical contact 30 may have a high coefficient of friction to also hamper removal of the sheath 20 when the sheath 20 is worn on the flexible electrical contact 30. The high coefficient of friction may be due to grip patterns on the inner surface 28 of the sheath 20. The sheath 20 may constrict around the flexible electrical contact 30 (with both the main body 26 and periphery rings 23, 25), and have an inner surface 28 of the sheath 20 with a high coefficient of friction to hamper removal of the sheath 20 when the sheath 20 is worn on the flexible electrical contact 30.

Referring to FIG. 4, there is shown an empty dry cell battery compartment/receptacle 52 of the sound reproduction device 50, where a first electrical contact 54 is shown wearing the second embodiment of the present invention, a sheath 20 with a conical main body 26. It should be noted that the other electrical contacts 56 are not wearing sheath 20. A connector 58 connecting the sound reproduction device 50 to an AC power source is shown, denoting that in such an instance where the dry cell battery compartment/receptacle 52 is empty (has no batteries), the sound reproduction device 50 may be powered by the AC power source. When the sound reproduction device 50 is operational in such an instance, the first electrical contact 54, and other electrical contacts 56 would generally tend to resonate and correspondingly create undesirable resonance noise (vibrations). These resonance noises directly affect the quality of sound reproduction produced by the sound reproduction device 50 in a detrimental manner. Wearing the sheath 20 on each electrical contact 54, 56 in the manner shown for the first electrical contact 54 (expanded view shown in FIG. 3) would damp a resonance vibration of each electrical contact 54, 56 during operation of the sound reproduction device 50. Doing this may enhance the quality of sound reproduction produced by the sound reproduction device 50.

With reference to FIG. 5, there is shown an instance of the dry cell battery compartment/receptacle 52 of the sound reproduction device 50 being fully loaded with batteries 60. It should be noted that the connector 58 has been removed (omitted), showing how the same sound reproduction device 50 is also operable using only batteries 60. More importantly, it can be seen that the first electrical contact 54 is still able to wear the sheath 20 when the batteries 60 are in contact with the electrical contact 54. Even though the sheath 20 may be made from an electrically insulating material, it can be seen from FIG. 3 that the sheath 20 does not hamper contact between the electrical contact 30 and a battery due to the open first end 22. It can be seen that the sheath 20 may be left on the electrical contact 54 regardless of power source selected by a user.

Figure 6:
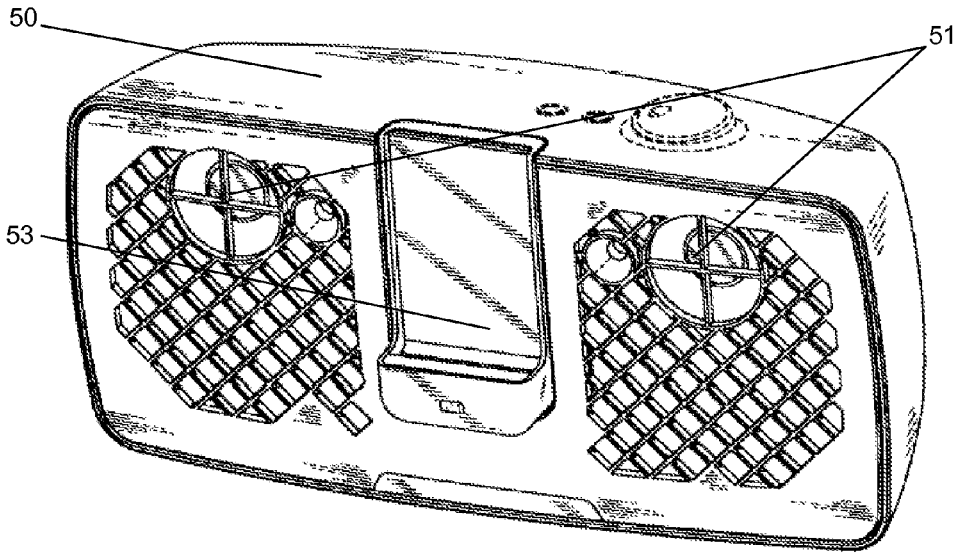
FIG. 6 shows a perspective view from another angle of the sound reproduction device of FIG. 4.

FIG. 6 shows a perspective view of the sound reproduction device 50 of FIGS. 4-5 from another angle. It should be noted that while the sound reproduction device 50 is shown to be a speaker 51 cum dock 53 for a portable digital entertainment device, the use of the sheath 20 should not be restricted for use with such specific types of devices.

Figure 7:
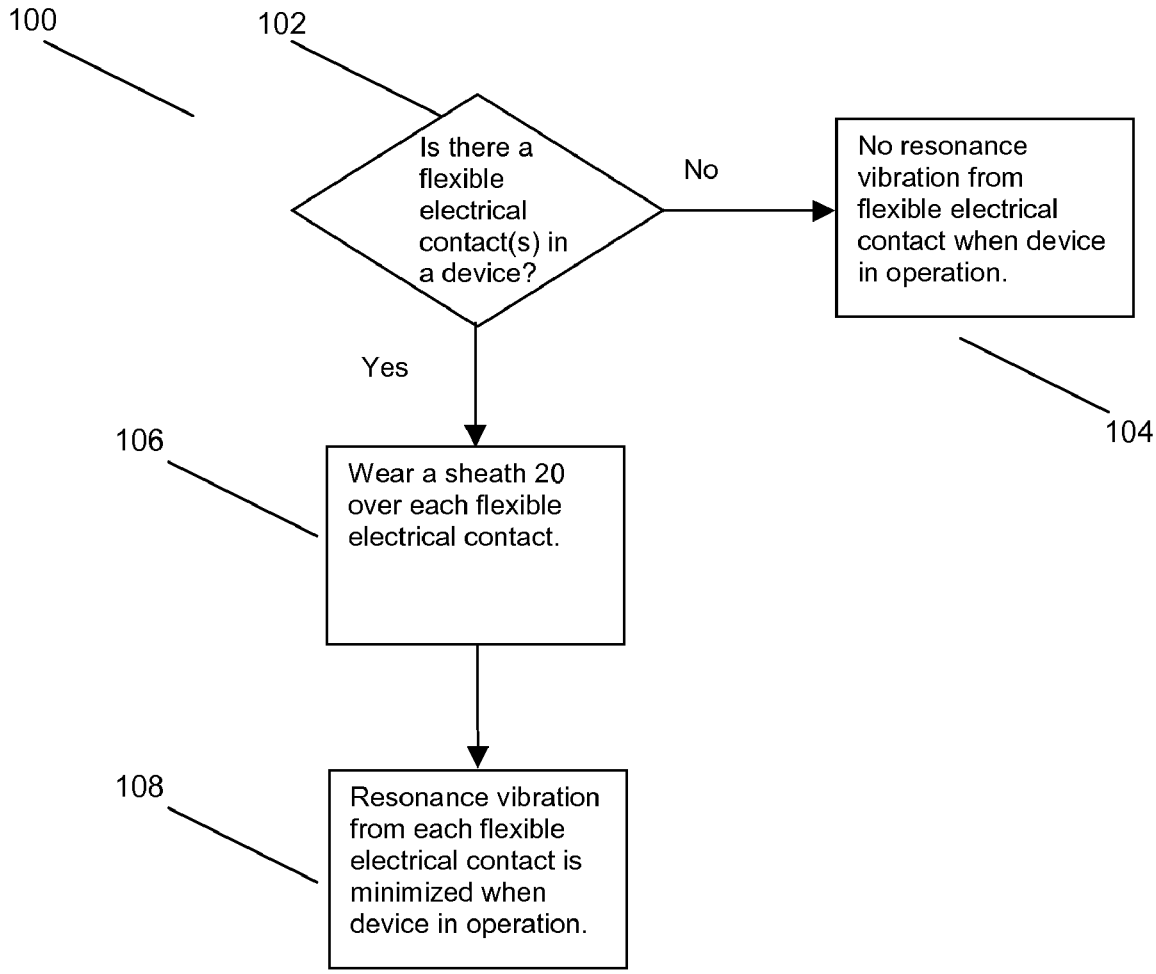
FIG. 7 shows a flow chart for a method of the present invention.

With reference to FIG. 7 and also by inference from the earlier sections of the description, there is also provided a method 100 to minimize resonance vibration from a flexible electrical contact 30 incorporated within an operational sound reproduction device 50 using a sheath 20 worn over the flexible electrical contact(s) 30.

Initially, there is a determination in relation to whether there are flexible electrical contact(s) 30 incorporated within the sound reproduction device 50 (102). If no, there would be no resonance vibration due to flexible electrical contact(s) 30 when the sound reproduction device 50 is in operation (104). If there are flexible electrical contact(s) 30 incorporated within the sound reproduction device 50, the sheath 20 should be worn over each flexible electrical contact(s) 30 (106). In this regard, resonance vibration from each flexible electrical contact(s) 30 may be minimized (damped by the sheath 20) when the sound reproduction device 50 is in operation (108).

It should be noted that the sheath 20 may be made from a material that may be heat-resistant, chemical resistant, elastic, flexible, compressible or any combination of the aforementioned. Heat resistance of the material may be essential as it would be detrimental to the performance of the electrical contact 30 if the sheath 20 melts or undergoes heat induced deformation. Chemical resistance of the material may be essential as it would be detrimental to the performance of the electrical contact 30 if the sheath 20 chemically reacts when coming into contact with chemicals like alkalis that leak from dry cell batteries. The material used for the sheath 20 may be either rubber or a polymer. The material used may enable the main body 26 of the sheath 20 to constrict around the electrical contact 30 when the sheath 20 is worn on the electrical contact 30. The constriction of the main body 26 of the sheath 20 around the electrical contact 30 may hamper removal of the sheath 20 when the sheath 20 is worn on the flexible electrical contact 30. Constriction of the thickened periphery rings 23, 25 may also aid in securing the sheath 20 to the electrical contact 30. Alternatively, an inner surface 28 of the sheath 20 in contact with the flexible electrical contact 30 may have a high coefficient of friction to also hamper removal of the sheath 20 when the sheath 20 is worn on the flexible electrical contact 30. The high coefficient of friction may be due to grip patterns on the inner surface 28 of the sheath 20. The sheath 20 may constrict around the flexible electrical contact 30 (with both the main body 26 and periphery rings 23, 25), and have an inner surface 28 of the sheath 20 with a high coefficient of friction to hamper removal of the sheath 20 when the sheath 20 is worn on the flexible electrical contact 30.

It should also be noted that the flexible electrical contact 30 need not refer only to those found in the dry cell battery compartment/receptacle 52 of the sound reproduction device 50. The flexible electrical contact 30 may refer to any such part incorporated in the sound reproduction device 50 that may vibrate during operation of the sound reproduction device 50.

Whilst there has been described in the foregoing description preferred embodiments of the present invention, it will be understood by those skilled in the technology concerned that many variations or modifications in details of design or construction may be made without departing from the present invention.

The invention claimed is:

1. A sheath for a flexible electrical contact that is incorporated within a sound reproduction device, the sheath including:

at least one opening at each end of the sheath to enable the sheath to be worn over the flexible electrical contact, each opening having a thickened periphery ring; and a main body with either a cylindrical shape or a conical shape, wherein the sheath damps a resonance vibration of the flexible electrical contact during operation of the sound reproduction device when the sheath is worn over the flexible electrical contact.

2. The sheath a claimed in claim 1, wherein the flexible electrical contact is incorporated within a battery compartment of the sound reproduction device.

3. The sheath as claimed in claim 1, wherein removal of the sheath when the sheath is worn on the flexible electrical contact is hampered due to measures selected from the group consisting of: constriction of the main body of the sheath around the flexible electrical contact, constriction of the thickened periphery rings on the flexible electrical contact, having a high coefficient of friction in an inner surface of the sheath contacting the flexible electrical contact and any combination of the aforementioned.

4. The sheath as claimed in claim 1, wherein the thickened periphery rings aid in securing the sheath to the flexible electrical contact during compression and subsequent rebound of the flexible electrical contact.

5. The sheath as claimed in claim 1, wherein the sheath is made of a material of a type selected form the group consisting of: heat-resistant, chemical-resistant, elastic, flexible, compressible and any combination of the aforementioned.

6. The sheath as claimed in claim 5, wherein the material is either rubber or a polymer.

7. A method to minimize resonance vibration from a flexible electrical contact incorporated within a sound reproduction device, the method comprising:

using a sheath worn over the flexible electrical contact, the sheath including:

at least one opening at each end of the sheath to enable the sheath to be worn over the flexible electrical contact, each opening having a thickened periphery ring; and a main body with either a cylindrical shape or a conical shape, wherein the sheath damps a resonance vibration of the flexible electrical contact during operation of the sound reproduction device when the sheath is worn over the flexible electrical contact.

8. The method as claimed in claim 7, wherein the flexible electrical contact is incorporated within a battery compartment of the sound reproduction device.

9. The method as claimed in claim 7, wherein removal of the sheath when the sheath is worn on the flexible electrical contact is hampered due to measures selected from the group consisting of: constriction of the main body of the sheath around the flexible electrical contact, constriction of the thickened periphery rings on the flexible electrical contact, having a high coefficient of friction in an inner surface of the sheath contacting the flexible electrical contact and any combination of the aforementioned.

10. The method as claimed in claim 7, wherein the thickened periphery rings aid in securing the sheath to the flexible electrical contact during compression and subsequent rebound of the flexible electrical contact.

11. The method as claimed in claim 7, wherein the sheath is made of a material of a type selected from the group consisting of: heat-resistant, chemical-resistant, elastic, flexible, compressible and any combination of the aforementioned.

12. The method as claimed in claim 11, wherein the material is either rubber or a polymer.

* * * * *